US010835909B2

(12) United States Patent
Warren

(10) Patent No.: US 10,835,909 B2
(45) Date of Patent: Nov. 17, 2020

(54) HEATER FOR EPOXY CARTRIDGES

(71) Applicant: Philip Warren, Carver, MA (US)

(72) Inventor: Philip Warren, Carver, MA (US)

(73) Assignee: Warren Environmental & Coating, LLC, Middleborough, MA (US)

( * ) Notice: Subject to any disclaimer, the term of this patent is extended or adjusted under 35 U.S.C. 154(b) by 144 days.

(21) Appl. No.: 15/338,345

(22) Filed: Oct. 29, 2016

(65) Prior Publication Data

US 2017/0121094 A1 May 4, 2017

Related U.S. Application Data

(60) Provisional application No. 62/248,082, filed on Oct. 29, 2015.

(51) Int. Cl.
*B05B 9/00* (2006.01)
*B05B 7/16* (2006.01)

(52) U.S. Cl.
CPC ..... *B05B 9/002* (2013.01); *B05B 7/166* (2013.01)

(58) Field of Classification Search
CPC ..... A47J 36/2483; A47J 36/0623; A47J 36/07009; A47J 36/006; A47J 47/14; A47J 47/145; A45C 11/20; B05B 9/002; B05B 7/166; B05B 7/22; B05B 7/26; B05B 7/1693; B05B 7/208; H05B 3/46; H05B 3/48; H05B 3/40; B05C 17/001; B05C 17/00553; B05C 17/000546; B05C 17/00523; B05C 17/0052; B05C 17/00546
See application file for complete search history.

(56) References Cited

U.S. PATENT DOCUMENTS 6,191,401 B1 * 2/2001 Salerno ..... A47J 47/14 126/246
6,658,857 B1 * 12/2003 George ..... F25B 21/04 165/121
7,122,763 B1 * 10/2006 Liu ..... A45C 11/20 219/214

* cited by examiner

*Primary Examiner* — Shawntina T Fuqua
(74) *Attorney, Agent, or Firm* — Barlow, Josephs & Holmes, Ltd.

(57) ABSTRACT

A heating assembly that receives pre-loaded two part epoxy cartridges and heats them in a controlled manner for spray application. Further, the heating assembly is modular in nature such that a plurality of pre-loaded cartridges can be efficiently loaded therein and uniformly heated. The heating assembly is a bag of durable construction and is structured to be heat resistant. The bag has a bottom, sides extending upwardly from the bottom and a operable panel at the top thereof to allow access to the interior of the bag. At least one wall of the bag includes a heater panel formed therein. More preferable more than one wall of the bag includes a heat panel therein. The panels are configured and arranged to impart heat to the interior of the bag while preferably being insulated about the exterior.

10 Claims, 2 Drawing Sheets

HEATER FOR EPOXY CARTRIDGES

CROSS-REFERENCE TO RELATED APPLICATIONS

This application is related to and claims priority from earlier filed U.S. Provisional Patent Application No. 62/248,082, filed Oct. 29, 2015.

BACKGROUND OF THE INVENTION

The present invention generally relates to a system for preheating cartridges containing two-part and/or self-setting compositions prior to their application. More specifically, the present invention relates to a system for efficiently and conveniently preheating prefilled cartridges containing viscous materials such as epoxies, caulking and the like to a temperature that promotes their smooth mixing and application as well as promoting a self-setting reaction.

Cartridges containing viscous materials such as caulking and a variety of two part materials in which mutually reactive liquids need to be mixed prior to their application. A preheating system is needed for maintaining the resin component or any of the components that must be in a preheated ready to use state so that when they are pumped into the system as separate components, they are already preheated so that the application process can begin immediately and continue as desired without delays.

Generally, epoxy coatings are well known in the art and due to their exceptional durability and structural properties epoxy based protective coatings have gained commercial acceptance as protective and decorative coatings for use on a wide variety of materials. For example, epoxy based protective coatings represent one of the most widely used methods of corrosion control. They are used to provide long term protection of steel, concrete, aluminum and other structures under a broad range of corrosive conditions, extending from atmospheric exposure to full immersion in highly corrosive environments. Further, epoxy coatings are readily available and are easily applied by a variety of methods including spraying, rolling and brushing. They adhere well to steel, concrete and other substrates, have low moisture vapor transmission rates and act as barriers to water, chloride and sulfate ion ingress, provide excellent corrosion protection under a variety of atmospheric exposure conditions and have good resistance to many chemicals and solvents. As a result, numerous industries including maintenance, marine, construction, architectural, aircraft and product finishing have adopted broad usage of epoxy coating materials.

The most common material utilized in the epoxy coating industry today is a multi-part epoxy material. In general, the epoxy includes a first base resin matrix and at least a second catalyst or hardener, although other components such as a pigment agent or an aggregate component may also be added. While the two parts remain separate, they remain in liquid form. After the two parts are mixed together, they begin a curing process that is typically triggered by exposure to heat, humidity or an ultra-violet light source, whereby the mixed material quickly begins to solidify. As a result, it is necessary to mix only a sufficient amount of compound such that it can be worked effectively before set up occurs. Accordingly, the use and application of these compounds is a tedious, slow and expensive proposition.

One such material, AQUATAPDXY (A-5 or A-6), is a proprietary, two-part self-setting compound which is designed to be applied under water or to wet surfaces. The product hardens into a ceramic like material which is resistive to chemical attack. This will set up into a coating that is smooth, hard and difficult to break or chip. This product, like most prior art coatings, has been difficult to use due to the preferred method of spray application. When attempting to spray apply an epoxy, two drawbacks are encountered. First, the material cannot be mixed in large batches prior to application because of the short pot life of the material. Accordingly, it must be mixed on an as needed basis immediately prior to spray application. Second, the naturally viscous consistency of the mixed epoxy material is not well suited for spray application.

To thin the epoxy to the consistency required for typical prior art spray application, the epoxy must be loaded with a large percent by volume of solvent. Such a solvent typically contains high level of volatile organic compounds (VOC) whose primary function is to lower viscosity thereby providing a consistency suitable for spray application with conventional air, airless and electrostatic spray equipment. The addition of the solvent to the epoxy coating material in turn greatly increases the VOC content of the epoxy coating material and reduces the build thickness of the finished and cured coating.

Accordingly, some advancement in applications technology has been developed. Among them are systems for controlling mixing and viscosity. While these systems have provided great advancements in use of some sealing compounds, there is still great room for improvement.

One example of an improvement discloses a spray application system and method for a two-part, self-setting compound, and provides needed advancement of application technology, opportunities for improvement remain. For example, in some instances, multiple coats of compound may be required. More specifically, due to the nature of a mixture of compounds that may be in use, a desired finish may not be attainable if the compounds are applied too thickly. Applying multiple coats necessarily requires additional time and energy, and therefore can be costly.

In contrast, attempts to apply a thick coating typically result in slumping of compound and may require considerable rework. In some environments, such as with underground piping, misapplication can be virtually disastrous.

In short, now that techniques for applications have been greatly improved, there are opportunities to further refine compounds suited for various applications. Thus, what is needed are methods and apparatus for efficiently applying sealing compounds in a production environment. Preferably, the methods and apparatus provide for a much thicker coating of material than previously achievable. Further, it is desirable to have methods and apparatus that enhance the variety of sealing compounds that may be applied and the increase applications for which the compounds may be used.

In view of the foregoing, there is a need for a method and system for controlling the viscosity and temperature of a two-part, self-setting composition in a manner that operates efficiently and allows superior spray application of the material.

BRIEF SUMMARY OF THE INVENTION

In this regard, the present invention relates to a heating assembly that receives pre-loaded two part epoxy cartridges and heats them in a controlled manner for spray application. Further, the heating assembly is configured and arranged to be modular in nature such that a plurality of pre-loaded cartridges can be efficiently loaded therein and uniformly heated to facilitate easy spray application of material having a much higher viscosity than was possible in the prior art.

In the prior art epoxy is loaded into cartridges having two dispensing tubes arranged side by side wherein the size of the two tubes is proportional to the mixing formula of the epoxy wherein one tube is usually smaller and one is larger. This allows two cartridges to neatly nest with one another within a rectangular space wherein the cartridges are flipped relative to one another such that the larger diameter tubes are positioned adjacent the smaller diameter tubes.

The present invention provides a bag structure that operates as a heating oven for these cartridges. The bag is of durable construction and is structured to be heat resistant. The bag has a bottom, sides extending upwardly from the bottom and a operable panel at the top thereof to allow access to the interior of the bag. At least one wall of the bag includes a heater panel formed therein. More preferable more than one wall of the bag includes a heat panel therein. The panels are configured and arranged to impart heat to the interior of the bag while preferably being insulated about the exterior.

In one embodiment the bag includes heat panels in the top and bottom walls thereof. In another embodiment the bag includes heat panels in one or more of the side walls. In still another embodiment the bag includes heat panels in two or more of any of the top bottom and side walls. Still further, the bag may include a divider structure therein such that a heat panel may also be included in the divider structure.

The bag is arranged to modularly receive and neatly support pairs of cartridges either through the use of interior dividers or by using modular packing dividers that receive a plurality of cartridges in the interfitting manner described above. The dividers may be cardboard or constructed from the same materials as the bag itself. The dividers may be disposable or reusable. The dividers may support the tubes and then be inserted into modular apertures within the interior of the bag and surrounded by heat plates contained in the walls of the modular apertures.

Heat plates can be rigid construction or of flexible construction as known in the art. The heat plates may be powered using conventional line voltage, i.e. 110 v, or through a car adapter operating at 12V DC. The heat plates preferably heat the interior contents and epoxy cartridges to between 150 degrees and 180 degrees Fahrenheit. More preferably the heat plates heat the contents of the bag to between 165 degrees and 180 degrees Fahrenheit.

The cartridges heated in this manner are not subjected to burning as was the case in the use of prior art heating belts and is maintained in a heated useable form through the duration of the job while not requiring multiple cartridges to be heated one at a time prior to immediate use. In this manner the cartridges are maintained at the optimal temperature such that the contents are of a viscosity that spray application is uniform and consistent.

Accordingly, the present invention contemplates a new and improved apparatus and method for heating high build structural epoxy materials preparatory to use which overcomes all of the above referred problems and others. The device permits the material to be heated in a relatively short period of time. Furthermore, due to the configuration of the apparatus and method of heating, none of the material is burned; consequently the device is economically desirable.

It is therefore an object of the present invention to provide a method and system for preheating a spray-applying a two-part, self-setting composition that provides desired properties. Further, it is an object of the present invention to provide a method and system for preheating a delivery system for epoxy components that is particularly adapted for delivering the components of the composition at a temperature that promotes their spray application as well as a self-setting reaction.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
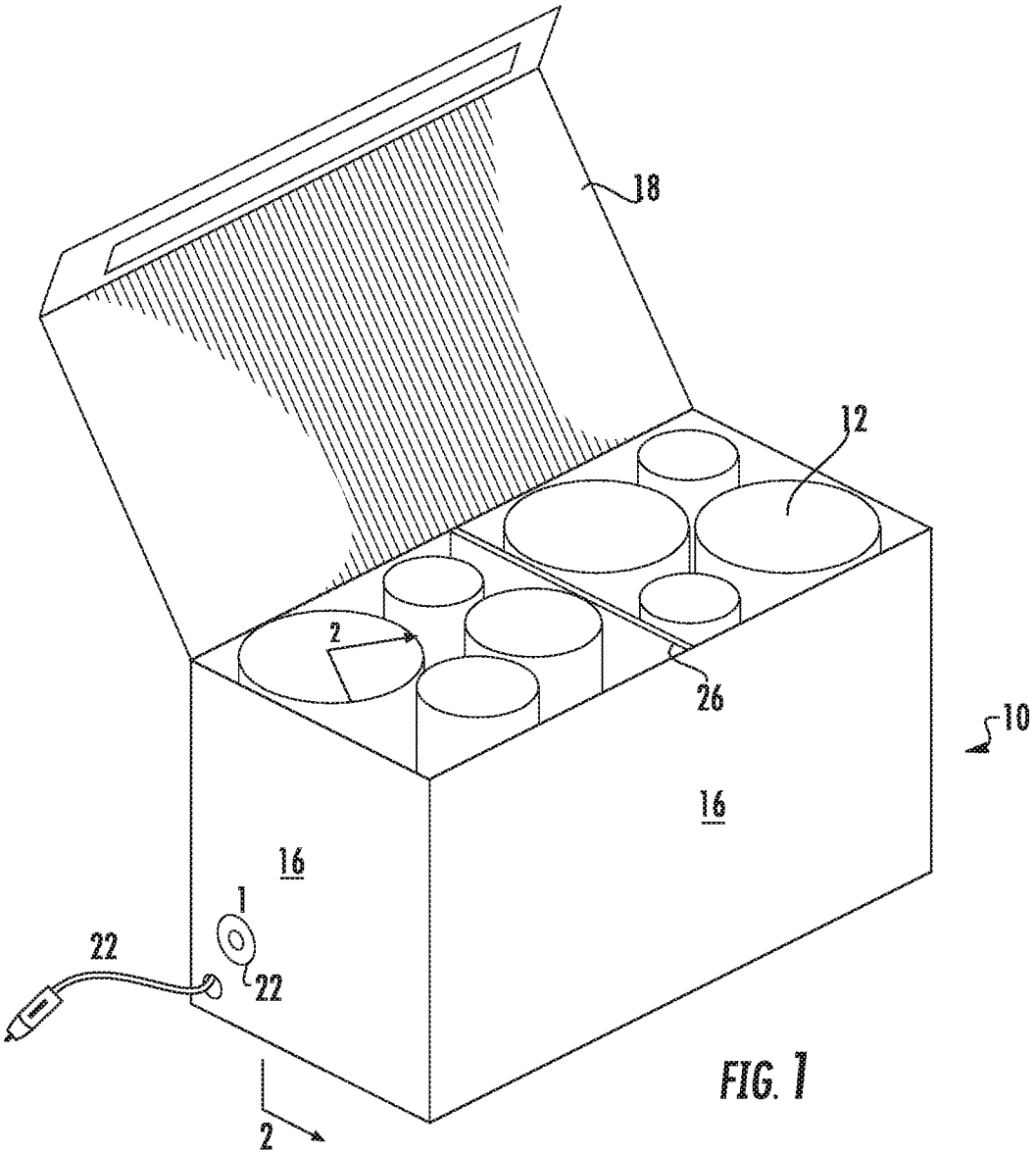
FIG. 1 is a perspective view of the heating bag in accordance with the present invention.
Figure 2:
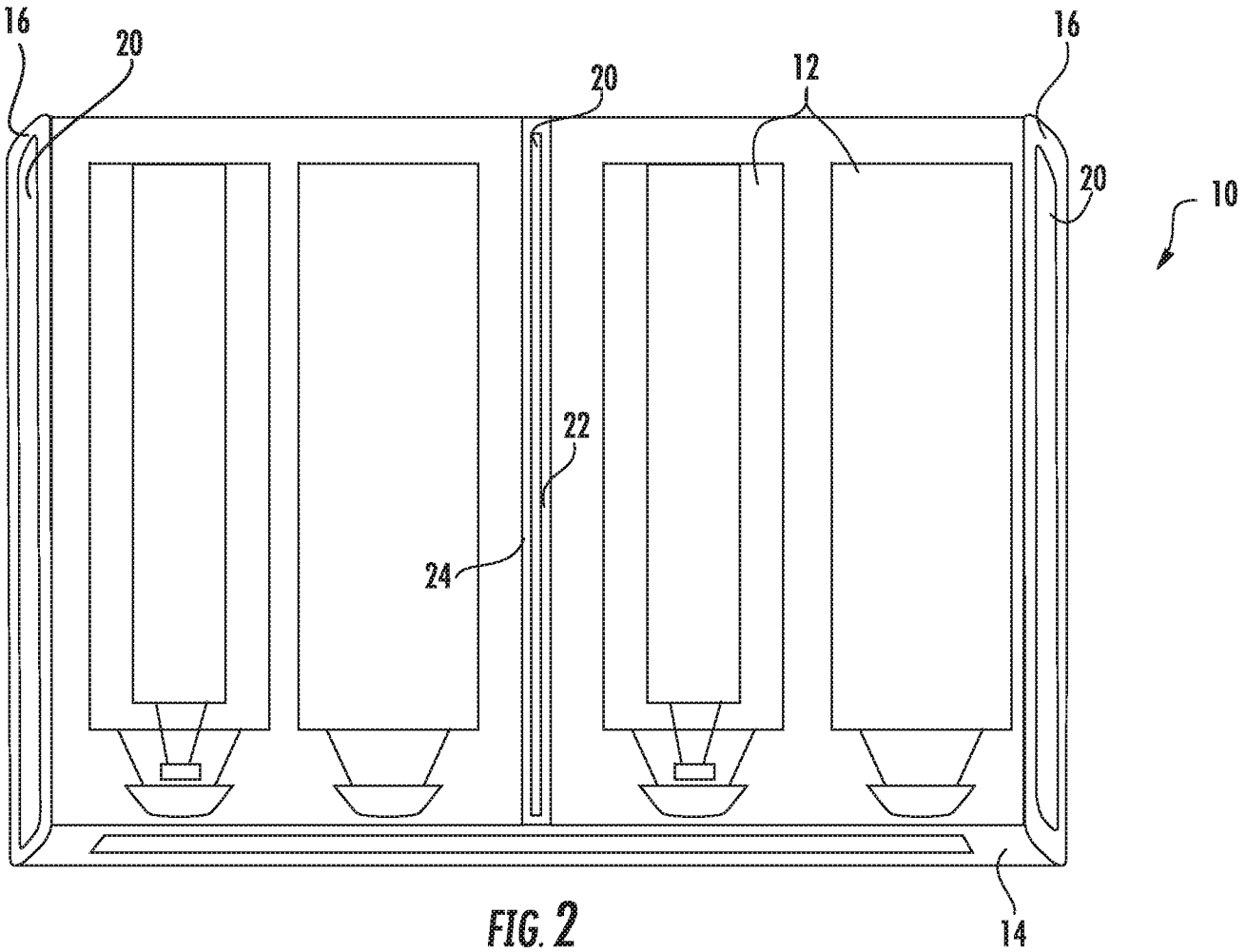
FIG. 2 is a cross-sectional view through the line 2-2 of FIG. 1.

Disclosed herein is a heating assembly that receives pre-loaded two part epoxy cartridges and heats them in a controlled manner for spray application. Further, the heating assembly is configured and arranged to be modular in nature such that a plurality of pre-loaded cartridges can be efficiently loaded therein and uniformly heated to facilitate easy spray application of material having a much higher viscosity than was possible in the prior art.

In the prior art epoxy is loaded into cartridges having two dispensing tubes arranged side by side wherein the size of the two tubes is proportional to the mixing formula of the epoxy wherein one tube is usually smaller and one is larger. This allows two cartridges to neatly nest with one another within a rectangular space wherein the cartridges are flipped relative to one another such that the larger diameter tubes are positioned adjacent the smaller diameter tubes.

The present invention provides a bag 10 structure that operates as a heating oven for these cartridges 12. The bag 10 is of durable construction and is structured to be heat resistant. The bag has a bottom 14, sides 16 extending upwardly from the bottom and a operable panel at the top 18 thereof to allow access to the interior of the bag. At least one wall of the bag includes a heater panel 20 formed therein. More preferable more than one wall of the bag includes a heat panel therein. The heater panels 20 are configured and arranged to impart heat to the interior of the bag while preferably being insulated about the exterior. The walls of the warming bag are comprised of an outer cover layer and a pair of insulation layers having resistive wiring sandwiched between them. The bag preferably has an opening that is sealable. The seal could be a zipper or a flap having hook and loop fastener material thereon. The warming bag has an electrical cord 22 fitted with a plug that engages with either an automotive electrical power outlet or in an alternative arrangement with a 110 volt power source. The electrically-heated insulated warming bag will now be described in detail with reference to the attached drawing figures.

A first embodiment partially-completed, electrically-heated insulated warming bag 10 having a first embodiment wiring pattern is shown. A heating plate 20 is sandwiched between a pair of insulation layers 22, 24 forming at least one wall of the bag. An outer cover layer may be woven fabric material, fabric-backed plasticized polyvinylchloride sheet material, or other similar material. The bag may include heating panels in more than one side wall, top wall, bottom wall or a combination thereof.

The bag 10 is formed in a modular manner such that it receives and retains one or more epoxy injection cartridges 12 therein. More preferably, the bag is arranged to modularly receive and neatly support pairs of cartridges either through the use of interior dividers 26 or by using modular packing dividers that receive a plurality of cartridges in the interfitting manner as shown in the figure. The dividers may be cardboard or constructed from the same materials as the bag itself. The dividers may be disposable or reusable. The dividers may support the tubes and then be inserted into modular apertures within the interior of the bag and surrounded by heat plates contained in the walls of the modular apertures.

The warming bag may be equipped with an optional thermostat 28 that maintains a set temperature with minimum consumption of electrical power. The temperature setting can be adjusted to compensate for variations in humidity levels, which are affected by local climate and the time of year. The warming bag has a power cord 22 fitted with a plug that engages a cigarette lighter socket, or other similar automotive electrical power outlet. Alternately, the plug may be configured and arranged to engage with a standard 110 v power supply.

Heat plates 20 can be rigid construction or of flexible construction as known in the art. The heat plates 20 may be powered using conventional line voltage, i.e. 110 v, or through a car adapter operating at 12V DC. The heat plates preferably heat the interior contents and epoxy cartridges to between 150 degrees and 180 degrees Fahrenheit. More preferably the heat plates heat the contents of the bag to between 165 degrees and 180 degrees Fahrenheit. This reduces the viscosity of the contents of the epoxy cartridges to improve their spray applicability. The cartridges heated in this manner are not subjected to burning as was the case in the use of prior art heating belts and is maintained in a heated useable form through the duration of the job while not requiring multiple cartridges to be heated one at a time prior to immediate use. In this manner the cartridges are maintained at the optimal temperature such that the contents are of a viscosity that spray application is uniform and consistent.

Accordingly, the present invention contemplates a new and improved apparatus and method for heating high build structural epoxy materials preparatory to use. The cartridges optimally maintaining the two components in s separated manner until application. The cartridge and the two epoxy components contained therein heated to an optimal temperature range such that the viscosity of the epoxy facilitates spray application for high build coatings. The device permits the material to be heated in a relatively short period of time and allows the preheating of numerous cartridges simultaneously. Furthermore, due to the configuration of the apparatus and method of heating, none of the material is burned; consequently the device is economically desirable.

It can therefore be seen that the present invention provides a method and system for preheating a spray-applying a two-part, self-setting composition that provides desired properties. Further, the present invention provides a method and system for preheating a delivery system for epoxy components that is particularly adapted for delivering the components of the composition at a temperature that promotes their spray application as well as a self-setting reaction.

Various other components may be included and called upon for providing for aspects of the teachings herein. For example, additional materials, combinations of materials and/or omission of materials may be used to provide for added embodiments that are within the scope of the teachings herein.

In the present application a variety of embodiments are described. It is to be understood that any combination of any of these variables can define an embodiment of the invention. For example, a combination of a particular dopant material, with a particular compound, applied in a certain manner might not be expressly stated, but is an embodiment of the invention. Other combinations of articles, components, conditions, and/or methods can also be specifically selected from among variables listed herein to define other embodiments, as would be apparent to those of ordinary skill in the art.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

Therefore, it can be seen that the present invention provides s delayed curing epoxy resin composition, wherein the hardener and resin components can be fully blended yet the curing reaction still be delayed to provide the composition with a long pot life. It can also be seen that the present invention to provides a method of lining a pipe system whereby a liner is fully wet out with a blended epoxy composition yet the curing reaction is delayed for an extended period allowing the wet out liner to be stored and installed before the reaction is activated.

What is claimed:

1. A heated storage carrier for epoxy dispensing cartridges, said cartridges having a first tube affixed side by side with a second tube, said first tube larger in diameter than said second tube, the carrier comprising:

a bag with a plurality of modular storage compartments therein having at least a bottom wall and side walls extending upwardly therefrom wherein modular dividers extend between said sidewalls to create modular compartments for epoxy dispensing cartridges;

an operable cover opposing said bottom wall and affixed to a top edge of one of the side walls, said cover serving to close said compartment, said cover operable to allow access to said storage compartment; and at least one heating plate disposed in each of said side and bottom walls and dividers, said heating plate maintaining said storage compartment between 150 degrees and 180 degrees Fahrenheit, wherein each of said modular compartments is sized to receive and retain first and second epoxy cartridges nested in opposed relation therein such that said first tube of said first cartridge is received adjacent said second tube of said second cartridge and said second tube of said first cartridge is received adjacent said first tube of said second cartridge.

2. The heated storage carrier of claim 1, wherein said heating plate operates on 12 v DC.

3. The heated storage carrier of claim 1, wherein said heating plate operates on 110 v AC.

4. The heated storage carrier of claim 1, wherein said at least one heating plate further comprising a heating plate in said bottom wall and a heating plate in said operable cover.

5. The heated storage carrier of claim 1, wherein said at least one heating plate further comprising a heating plate in said bottom wall and a heating plate in at least one of said side walls.

6. The heated storage carrier of claim 1, wherein said storage compartment maintains epoxy cartridges at an optimal temperature range such that the viscosity of the epoxy facilitates spray application for high build coatings.

7. The heated storage carrier of claim 1, further comprising a modular divider extending across said storage compartment.

8. The heated storage carrier of claim 7, wherein said at least one heating plate further comprising a heating plate in said modular divider.

9. The heated storage carrier of claim 7, wherein said at least one heating plate further comprising a heating plate in said bottom wall and a heating plate in at least said modular divider.

10. The heated storage carrier of claim 7, wherein said storage compartment maintains epoxy cartridges at an optimal temperature range such that the viscosity of the epoxy facilitates spray application for high build coatings.

* * * * *